US009511581B2

(12) United States Patent
Jang et al.

(10) Patent No.: US 9,511,581 B2
(45) Date of Patent: Dec. 6, 2016

(54) APPARATUS AND METHOD FOR SYNCHRONIZING A ROLL-TO-ROLL TRANSFER DEVICE

(71) Applicant: KOREA INSTITUTE OF MACHINERY & MATERIALS, Daejeon (KR)

(72) Inventors: Bongkyun Jang, Daejeon (KR); Jae-Hyun Kim, Daejeon (KR); Kwang-Seop Kim, Daejeon (KR); Hak-Joo Lee, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 3 days.

(21) Appl. No.: 14/891,884

(22) PCT Filed: Dec. 30, 2013

(86) PCT No.: PCT/KR2013/012366

§ 371 (c)(1),
(2) Date: Nov. 17, 2015

(87) PCT Pub. No.: WO2014/189192

PCT Pub. Date: Nov. 27, 2014

(65) Prior Publication Data

US 2016/0089872 A1 Mar. 31, 2016

(30) Foreign Application Priority Data

May 24, 2013 (KR) ..... 10-2013-0059053

(51) Int. Cl.
*B41F 3/58* (2006.01)
*B65H 20/02* (2006.01)

(52) U.S. Cl.
CPC ..... *B41F 3/58* (2013.01); *B65H 20/02* (2013.01); *B65H 2513/106* (2013.01);
(Continued)

(58) Field of Classification Search
None
See application file for complete search history.

(56) References Cited

U.S. PATENT DOCUMENTS

2013/0042774 A1 2/2013 Yeo et al.

FOREIGN PATENT DOCUMENTS

KR 10-2009-0132816 A 12/2009
KR 10-2010-0002992 A 1/2010
(Continued)

OTHER PUBLICATIONS

International Search Report mailed Apr. 7, 2014 in International Application No. PCT/KR2013/012366, filed Dec. 30, 2013.

*Primary Examiner* — Joshua D Zimmerman
(74) *Attorney, Agent, or Firm* — Hauptman Ham, LLP

(57) ABSTRACT

In an apparatus and a method for synchronizing a roll-to-roll transfer device, the apparatus includes a thin-film, a first roller, a second roller, a first load sensing element and a control part. The thin-film is transferred by the roll-to-roll transfer device. The first roller makes contact with a lower surface of the thin-film, and rotates with a rotational axis via a first rotational element. The second roller is disposed over the first roller, makes contact with an upper surface of the thin-film, and rotates with the rotational axis via a second rotational element. The first load sensing element senses a load of the first roller or a load of the second roller. The control part synchronizes a translational velocity of the first rotational element or the second rotational element based on the load sensed by the first load sensing element.

13 Claims, 7 Drawing Sheets

(52) U.S. Cl.
CPC .. *B65H 2515/312* (2013.01); *B65H 2553/212* (2013.01); *B65H 2601/2532* (2013.01)

(56) References Cited

FOREIGN PATENT DOCUMENTS

| | | | |
|---|---|---|---|
| KR | 10-2011-0127623 | A | 11/2011 |
| KR | 10-2012-0044825 | A | 5/2012 |
| KR | 10-2013-0019298 | A | 2/2013 |

APPARATUS AND METHOD FOR SYNCHRONIZING A ROLL-TO-ROLL TRANSFER DEVICE

RELATED APPLICATIONS

The present application is a National Phase of International Application Number PCT/KR2013/012366, filed Dec. 30, 2013, and claims priority from Korea Application Number 10-2013-0059053, filed May 24, 2013.

BACKGROUND

1. Field of Disclosure

The present disclosure of invention relates to an apparatus and a method for synchronizing a roll-to-roll transfer device. More particularly, the present disclosure of invention relates to an apparatus and a method for synchronizing a roll-to-roll transfer device capable of preventing a failure or a damage of a nano thin-film in transferring the nano thin-film using a synchronizing device via a roll-to-roll feeding process.

2. Description of Related Technology

In the conventional semiconductor process for manufacturing an electronic device, a substrate used in the process is limited because of the manufacturing process requiring high temperature. Thus, a nano thin-film roll transfer process, in which a nano thin-film device manufactured in the semiconductor process is detached from a rigid substrate and then is transferred to a flexible substrate, has attracted great interest in the field of flexible electronics. This transfer process is called by a plate to roll (P2R) transfer technique; the plate is typically a wafer with thin film devices, and the roll is the stamp for picking the thin film devices and for placing them on a polymeric film.

However, in the above-mentioned P2R transfer process, the size of the thin-film is limited by the size of the wafer or a rigid substrate endurable for high temperature process. To overcome this size limitation and increase the productivity, a continuous transfer process is required. One of the methods for continuously transferring the nano thin-film is the roll-to-roll process. In the roll-to-roll process, the nano thin-film is disposed between a pair of rollers and the rollers continuously make contact between the nano thin-film and a continuous film of polymer.

In a roll-to-roll transfer device, a contact surface between the roller and the nano thin-film should be precisely controlled because a cylindrical roller is used and thus the roller and the nano thin-film make continuous contact with each other. Without the precise control, as illustrated in FIG. 1, creases A1 or cracks A2 occur in the nano thin-film and thus the electrical or mechanical quality of the transferred thin film degrades.

In the transfer process, the creases or cracks may be caused by deformation of the roller or irregular load of the roller due to the contact between the roller and the nano thin-film or between the pairs of rollers.

A vertical load on the roll stamp can be controlled to decrease the creases or cracks of the nano thin-film in the transfer process. The creases or cracks can also occur when a horizontal load is applied to the nano thin-film, and thus the horizontal load should be controlled or minimized together with the vertical load. To minimize the horizontal load, linear velocities on surfaces of the pair of contacted rollers should be synchronized during the rotation of the rollers.

For example, when one of the rollers rotates faster than the other, the horizontal load is ununiformly applied to the nano thin-film and thus the creases or cracks may occur. Even though the rotational velocities of the pair of rollers are uniformly controlled, lengths of circumferences of the paired rollers and may be different with each other due to the machining uncertainty or the wear of the rollers, and thus the linear velocity of the paired rollers may also be different with each other.

When the nano thin-film is damaged during the roll-to-roll transfer process, the performance of the nano thin-film device may degrade.

Accordingly, the transfer of the nano thin-film should be monitored, the rotational velocities of the pair of rollers should be individually controlled, and thus the horizontal load induced by the difference of the linear velocities of the paired rollers should be minimized.

Related prior art is Korean laid-open application No. 10-2012-0044825.

SUMMARY

The present invention is developed to solve the above-mentioned problems of the related arts. The present invention provides an apparatus and a method for synchronizing a roll-to-roll transfer device controlling rotational velocities of rollers to minimize a frictional force induced by the difference between the linear velocities of the contacted rollers using a load cell.

According to an example embodiment of an apparatus for synchronizing a roll-to-roll transfer device, the apparatus includes a thin-film, a first roller, a second roller, a first load sensing element and a control part. The thin-film is transferred by the roll-to-roll transfer device. The first roller makes contact with a lower surface of the thin-film, and rotates with a rotational axis via a first rotational element. The second roller is disposed over the first roller, makes contact with an upper surface of the thin-film, and rotates with the rotational axis via a second rotational element. The first load sensing element senses a load of the first roller or a load of the second roller. The control part synchronizes a translational velocity of the first rotational element or the second rotational element based on the load sensed by the first load sensing element.

In an example embodiment, the first load sensing element may include a first vertical load sensor and a first horizontal load sensor. The first vertical load sensor senses a load perpendicular to the rotational axis and perpendicular to a transfer direction of the thin-film. The first horizontal load sensor senses a load perpendicular to the rotational axis and parallel with the transfer direction.

In an example embodiment, the control part may measure a frictional force between the thin-film and the first and second rollers using the first load sensing element, and synchronize the translational velocity of the first rotational element or the second rotational element to minimize the frictional forces.

In an example embodiment, the apparatus may further include a third roller, a fourth roller, a fifth roller, a second load sensing element and a tension sensing element. The third roller may be spaced apart from the first roller along a transfer direction of the thin-film, make contact with the lower surface of the thin-film, and rotate with the rotational axis via a third rotational element. The fourth roller may be disposed over the third roller, make contact with an upper surface of the thin-film, and rotate with the rotational axis via a fourth rotational element. The fifth roller may be disposed between the first and third rollers, make contact with the upper surface or the lower surface of the thin-film, and rotate with the rotational axis via a fifth rotational element. The second load sensing element may sense a load of the third roller or the fourth roller. The tension sensing element may sense a tension of the thin-film on the fifth roller. The control part may synchronize a translational velocity of the third rotational element or the fourth rotational element based on the load sensed by the second load sensing element, and synchronize rotational angular velocities of at least one of the first and fourth rotational elements by the tension sensing element.

In an example embodiment, the second load sensing element may include a second vertical load sensor and a second horizontal load sensor. The second vertical load sensor may sense a load perpendicular to the rotational axis and perpendicular to a transfer direction of the thin-film. The second horizontal load sensor may sense a load perpendicular to the rotational axis and parallel with the transfer direction.

In an example embodiment, the tension sensing element may include a third horizontal load sensor sensing a load perpendicular to the rotational axis of the fifth roller and perpendicular to the transfer direction.

In an example embodiment, the tension sensing element may be a dancer-roll disposed on the fifth roller.

In an example embodiment, the control part may measure a frictional force between the thin-film and the third and fourth rollers using the second load sensing element, and synchronize the translational velocity of the third rotational element or the fourth rotational element to minimize the frictional forces. The control part may measure a tension of the thin-film between two pairs of rollers, one pair being the first and second rollers, the other pair being the third and fourth rollers using the tension sensing element, and synchronize the translational velocity of the first and second rotational elements or the third and fourth rotational elements to uniformly maintain the tension.

In an example embodiment, the fifth roller may include a main roller and a sub roller. The main roller may make contact with the lower surface of the thin-film, and a lower end of the main roller may be disposed over upper ends of the first and third rollers. The sub roller may be disposed at both sides of the main roller along the transfer direction of the thin-film, and a lower end of the sub roller may be disposed parallel with the upper ends of the first and third rollers.

In an example embodiment, the first to third vertical load sensors and the first and second horizontal load sensors may be load cells.

According to an example embodiment of a method for synchronizing a roll-to-roll transfer device, a load of a first roller or a second roller is sensed using a first load sensing element. A frictional force between a thin-film and the first and second rollers is measured using the load sensed by the first load sensing element. A translational velocity of a first rotational element or a second rotational element is synchronized to minimize the frictional force via a control part In an example embodiment, a load of a third roller or a fourth roller may be sensed using a second load sensing element. A frictional force between the thin-film and the third and fourth rollers may be estimated using the load sensed by the second load sensing element. A translational velocity of a third rotational element or a fourth rotational element may be synchronized to minimize the frictional force via the control part.

In an example embodiment, a load of a fifth roller may be sensed using a tension sensing element. A tension between the thin-film between the first and second rollers and between the third and fourth rollers may be estimated using the load sensed by the tension sensing element. The translational velocity of the first and second rotational elements or the third and fourth rotational elements may be synchronized to uniformly maintain the tension.

In an example embodiment, a tension of the thin-film on a fifth roller may be sensed using a dancer-roll. The translational velocity of the first and second rotational elements or the third and fourth rotational elements may be synchronized to uniformly maintain the tension.

According to the example embodiments of the present invention, the roll-to-roll transfer device of the nano thin-film benefits from the increased productivity.

In addition, the nano thin-film may be prevented from being damaged in transferring, and thus the performance of the nano thin-film may be increased and a high performance flexible device may be more easily manufactured.

BRIEF DESCRIPTION OF THE DRAWINGS

The above and other features and advantages will become more apparent by describing exemplary embodiments thereof with reference to the accompanying drawings, in which.

DETAILED DESCRIPTION

Hereinafter, exemplary embodiment of the invention will be explained in detail with reference to the accompanying drawings.

<Example Embodiment of Synchronizing Apparatus 1>

Figure 1:
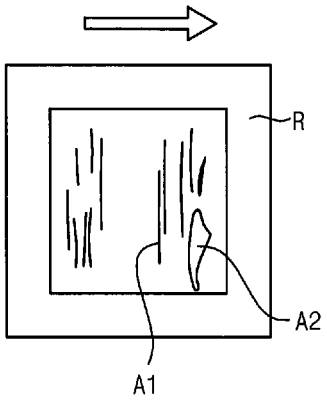
FIG. 1 is a plan view illustrating a nano thin-film have creases and cracks occurring in the conventional nano thin-film roll transfer process.
Figure 2:
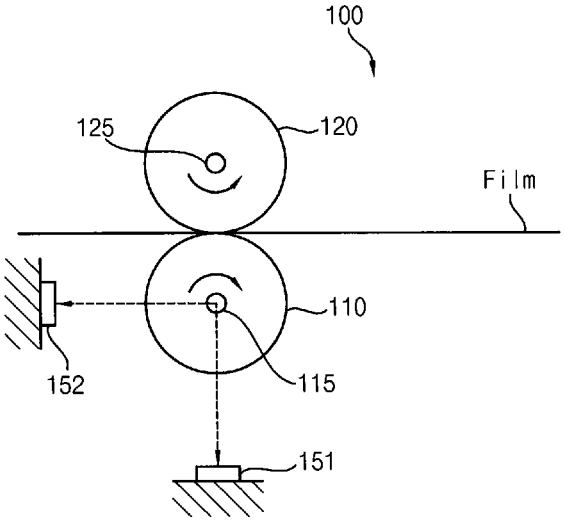
FIG. 2 is a side view illustrating a synchronizing apparatus of two rollers according to an example embodiment of the present invention.
Figure 3:
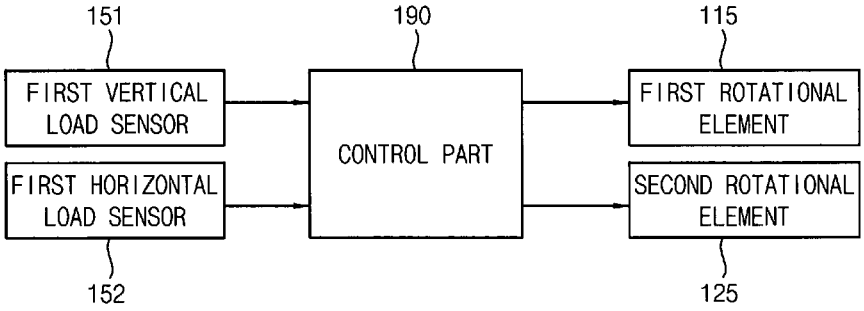
FIG. 3 is a block diagram illustrating the synchronizing apparatus of FIG. 2.

FIG. 2 is a side view illustrating a synchronizing apparatus of two rollers according to an example embodiment of the present invention. FIG. 3 is a block diagram illustrating the synchronizing apparatus of FIG. 2. Referring to FIGS. 2 and 3, the synchronizing apparatus 100 according to the present example embodiment includes a first roller 110, a second roller 120, a first rotational element 115, a second rotational element 125, a first load sensing element 151 and 15, and a control part 190.

The first roller 110 is a conventional cylindrical roller. The first roller 110 is disposed under a nano thin-film and makes contact with a lower surface of the nano thin-film. The first roller 110 rotates with a rotational axis via a first rotational element 115. As the first roller 110 rotates with the rotational axis, the nano thin-film is transferred along a transfer direction perpendicular to the rotational axis. Here, the transfer direction may be defined as a direction of a feeding of the film between two contacted rollers.

The second roller 120 is a conventional cylindrical roller. The second roller 120 is disposed over the nano thin-film and makes contact with an upper surface of the nano thin-film. A lower portion of the second roller 120 faces an upper portion of the first roller 110 and the nano thin-film is disposed between the first and second rollers 110 and 120. The second roller 120 rotates with a rotational axis via a second rotational element 125. A rotational direction of the second roller 120 is opposite to that of the first roller 110. As the second roller 120 rotates with the rotational axis, the nano thin-film is transferred along the transfer direction perpendicular to the rotational axis. Here, a frictional force between the first and second rollers 110 and 120 should be minimized and the nano thin-film should be prevented from being damaged in transferring.

The first load sensing element 151 and 152 senses the load of the first roller 110 or that of the second roller 120. In the figure, the first load sensing element 151 and 152 is configured to the first roller 110, but the first load sensing element 151 and 152 may be configured to the second roller 120. The first load sensing element 151 and 152 includes a first vertical load sensor 151 sensing a first vertical load of the first roller 110, and a first horizontal load sensor 152 sensing a first horizontal load of the first roller 110. The first vertical load is defined as the load perpendicular to the rotational axis and the transfer direction, and the first horizontal load is defined as the load perpendicular to the rotational axis and parallel with the transfer direction. The first vertical load sensor 151 and the first horizontal load sensor 152 sense the load between the nano thin-film and the roller, and thus include load cells accurately and precisely sensing the load.

The control part 190 receives the load information from the first vertical load sensor 151 and the first horizontal load sensor 152, and controls a translational velocity of the first rotational element 115 or the second rotational element 125. For example, the control part 190 measures a frictional force between the nano thin-film and the first and second rollers 110 and 120 based on the load information from the first vertical load sensor 151 and the first horizontal load sensor 152, and synchronizes the translational velocity of the first rotational element 115 or the second rotational element 125 to minimize the frictional force.

Accordingly, the frictional force between the nano thin-film and the first and second rollers 110 and 120 may be minimized and thus the nano thin-film may be less damaged in transferring. In addition, the translational velocity may be accurately and precisely controlled even though the circumference of the first and second rollers 110 and 120 changes due to wear or deformation of the first and second rollers 110 and 120.

<Example Embodiment of Synchronizing Apparatus 2>

Figure 4:
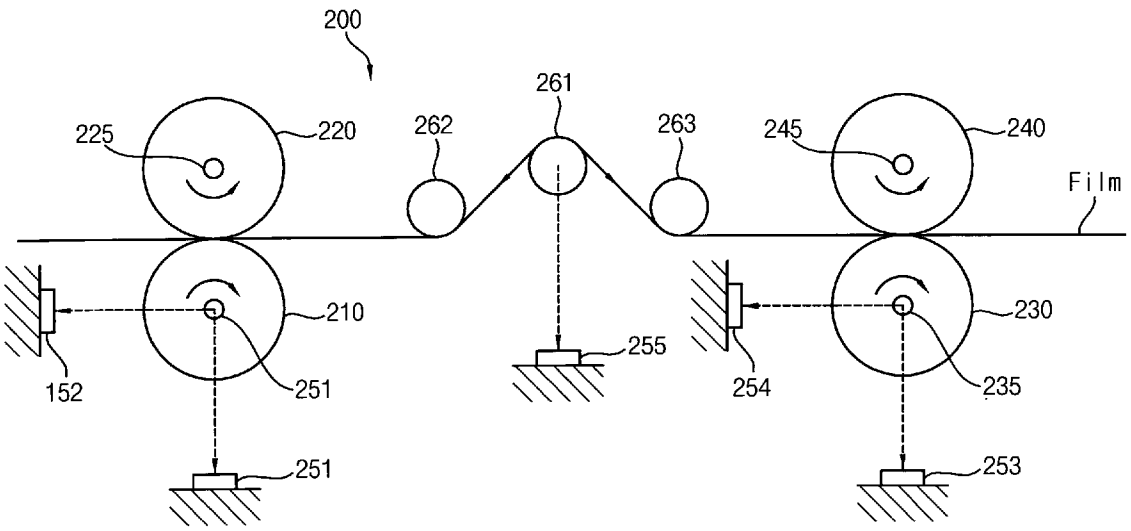
FIG. 4 is a side view illustrating a synchronizing apparatus of two rollers and tension control rollers according to another example embodiment of the present invention.
Figure 5:
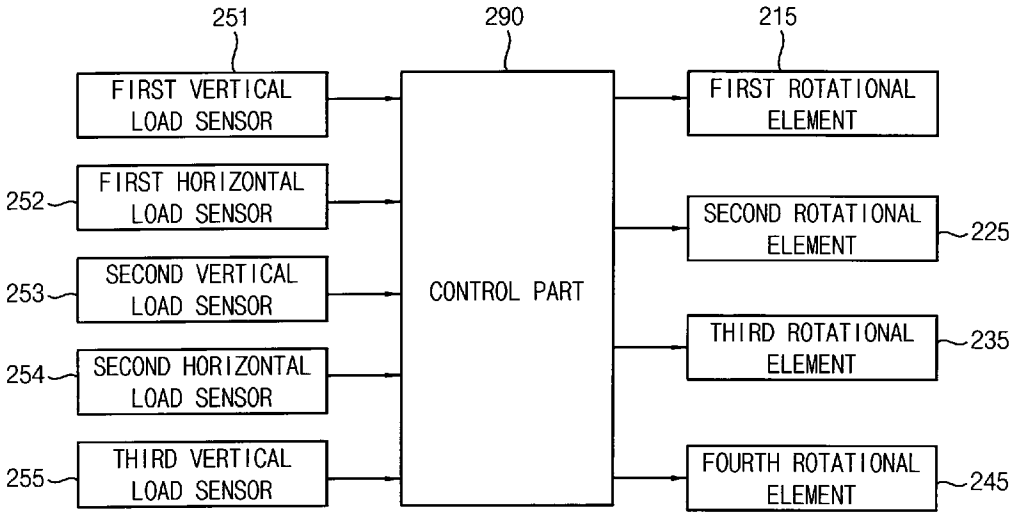
FIG. 5 is a block diagram illustrating the synchronizing apparatus of FIG. 4.

FIG. 4 is a side view illustrating a synchronizing apparatus of two pair of rollers and tension control rollers according to another example embodiment of the present invention. FIG. 5 is a block diagram illustrating the synchronizing apparatus of FIG. 4.

Referring to FIGS. 4 and 5, the synchronizing apparatus according to the present example embodiment includes a first roller 210, a second roller 220, a third roller 230, a fourth roller 240, a fifth roller 261, 262 and 263, a first rotational element 215, a second rotational element 225, a third rotational element 235, a fourth rotational element 245, a first load sensing element 251 and 252, a second load sensing element 253 and 254, a tension sensing element 255 and a control part 290.

The first roller 210, the second roller 220, the first rotational element 215, the second rotational element 225 and the first load sensing element 251 and 252 are substantially same as the first roller 110, the second roller 120, the first rotational element 115, the second rotational element 125 and the first load sensing element 151 and 252, and thus repetitive explanation may be omitted.

The third roller 230 is a conventional cylindrical roller. The third roller 230 is spaced apart from the first roller 210 along the transfer direction, and the nano thin-film transfers from the first roller 210 to the third roller 230. The third roller 230 is disposed under a nano thin-film and makes contact with a lower surface of the nano thin-film. The third roller 230 rotates with a rotational axis via a third rotational element 235. As the third roller 230 rotates with the rotational axis, the nano thin-film is transferred along the transfer direction perpendicular to the rotational axis.

The fourth roller 240 is a conventional cylindrical roller. The fourth roller 240 is spaced apart from the second roller 220 along the transfer direction, and the nano thin-film transfers from the second roller 220 to the fourth roller 240. The fourth roller 240 is disposed over the nano thin-film and makes contact with an upper surface of the nano thin-film. A lower portion of the fourth roller 240 faces an upper portion of the third roller 230 and the nano thin-film is disposed between the fourth and third rollers 240 and 230. The fourth roller 240 rotates with a rotational axis via a fourth rotational element 245. A rotational direction of the fourth roller 240 is opposite to that of the second roller 230. As the fourth roller 240 rotates with the rotational axis, the nano thin-film is transferred along the transfer direction perpendicular to the rotational axis. Here, a frictional force between the third and fourth rollers 230 and 240 should be minimized and the nano thin-film should be prevented from being damaged in transferring.

The second load sensing element 253 and 254 senses the load of the third roller 230 or that of the fourth roller 240. In the figure, the second load sensing element 253 and 254 is configured to the third roller 230, but the second load sensing element 253 and 254 may be configured to the fourth roller 240. The second load sensing element 253 and 254 includes a second vertical load sensor 253 sensing a second vertical load of the third roller 230, and a second horizontal load sensor 254 sensing a second horizontal load of the third roller 230. The second vertical load is defined as the load perpendicular to the rotational axis and the transfer direction, and the second horizontal load is defined as the load perpendicular to the rotational axis and parallel with the transfer direction. The second vertical load sensor 253 and the second horizontal load sensor 254 sense the load between the nano thin-film and the roller, and thus include load cells accurately and precisely sensing the load.

The fifth roller 261, 262 and 263 is disposed between the first and second rollers 210 and 220 and the third and fourth rollers 230 and 240. The fifth roller 261, 262 and 263 includes a main roller 261 sensing a tension between the first and second rollers 210 and 220 and the third and fourth rollers 230 and 240, and a pair of sub rollers 262 and 263 disposed at both sides of the main roller 261 along the transfer direction.

The main roller 261 is a conventional cylindrical roller. The main roller 261 is disposed over the nano thin-film or under the nano thin-film. When the main roller 261 is disposed under the nano thin-film, an upper portion of the main roller 261 makes contact with the lower surface of the nano thin-film. When the main roller 261 is disposed over the nano thin-film, a lower portion of the main roller 261 makes contact with the upper surface of the nano thin-film. Hereinafter, the main roller 261 disposed under the nano thin-film will be explained. The lower portion of the main roller 261 is disposed over upper portions of the first and third rollers 210 and 230. The pair of sub rollers 262 and 263 are disposed at both sides of the main roller 261, and lower portions of the sub rollers 262 and 263 is substantially parallel with the upper portions of the first and third rollers 210 and 230. The sub rollers 262 and 263 are conventional cylindrical roller, are disposed over the nano thin-film, and make contact with the lower surface of the nano thin-film. The fifth roller 261, 262 and 263 freely rotates along the transfer of the nano thin-film.

The tension sensing element 255 senses the tension of the nano thin-film on the main roller 261. The tension sensing element 255 includes a third vertical load sensor sensing a third vertical load. The third vertical load is defined as the load perpendicular to the rotational axis and the transfer direction. The tension sensing element 255 may be a load cell accurately and precisely sensing the load between the nano thin-film and the roller.

Although not shown in the figure, the tension sensing element 225 may include a dancer-roll configured in the main roller 261. The dancer-roll may directly measure the tension of the nano thin-film on the main roller 261.

The control part 290 receives the load information from the first vertical load sensor 251, the first horizontal load sensor 252, the second vertical load sensor 253, the second horizontal load sensor 254 and the third vertical load sensor 255, and controls a translational velocity of at least one of the first to fourth rotational elements 215, 225, 235 and 245. For example, the control part 290 measures the frictional force between the nano thin-film and the first and second rollers 210 and 220 based on the load information from the first vertical load sensor 251 and the first horizontal load sensor 252, and synchronizes the translational velocity of the first rotational element 215 or the second rotational element 225 to minimize the frictional force. In addition, the control part 290 measures the frictional force between the nano thin-film and the third and fourth rollers 230 and 240 based on the load information from the second vertical load sensor 253 and the second horizontal load sensor 254, and synchronizes the translational velocity of the third rotational element 235 or the fourth rotational element 245 to minimize the frictional force.

Further, the control part 290 measures the tension of the nano thin-film transferring on the main roller 261 based on the load information from the third vertical load sensor 255, and synchronizes the translational velocity of the first and second rotational elements 215 and 225 or the third and fourth rotational elements 235 and 245. As mentioned above, the tension of the nano thin-film may be directly provided to the control part 290 through the dancer-roll configured in the main roller 261 instead of the third vertical load sensor 255.

Accordingly, the frictional force between the nano thin-film and the first to fourth rollers 210, 220, 230 and 240 may be minimized and thus the nano thin-film may be less damaged in transferring. In addition, the translational velocity may be accurately and precisely controlled even though the circumference of the first to fourth rollers 210, 220, 230 and 240 changes due to wear or deformation of the first to fourth rollers 210, 220, 230 and 240. Further, the tension of the nano thin-film in the roll-to-roll transfer device may be sensed and controlled in synchronization, and thus the nano thin-film may be prevented from being damaged of deformed in transferring.

Hereinafter, a method for synchronizing a roll-to-roll transfer device will be explained.

<Example Embodiment of Synchronizing Method 1>

Figure 6:
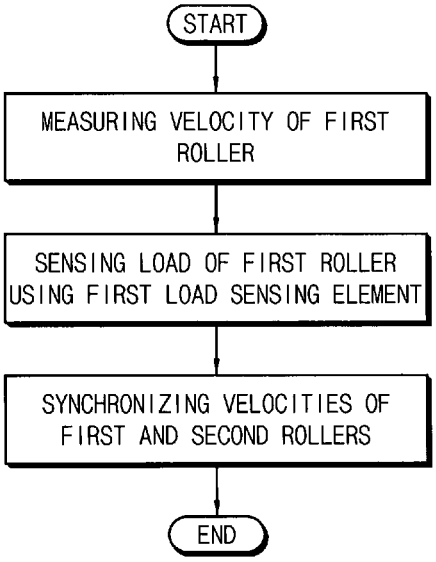
FIG. 6 is a flow chart illustrating a synchronizing method using the synchronizing apparatus of FIG. 2.

FIG. 6 is a flow chart illustrating a synchronizing method using the synchronizing apparatus of FIG. 2. Referring to FIG. 6, in the synchronizing method according to the present example embodiment, a velocity of the first roller 110 is preset and a velocity of the second roller 120 is synchronized based on the load of the first roller 110 via the first load sensing element 151 and 152.

First, the velocity of the first roller 110 is measured, and then the load of the first roller 110 is sensed using the first load sensing element 151 and 152. The first load sensing element 151 and 152 includes the first vertical load sensor 151 and the first horizontal load sensor 152, and senses the vertical load and the horizontal load applied to the first roller 110. Then, the control part 190 measures the frictional force between the nano thin-film and the first and second rollers 110 and 120 based on the vertical load and the horizontal load. The frictional force may be measured based on the conventional calculation equation to get the frictional force.

Then, the control part 190 synchronizes the translational velocity of the first rotational element 115 or the second rotational element 125 to minimize the frictional force, and the synchronizing may be performed in real time.

Accordingly, the frictional force between the nano thin-film and the first and second rollers 110 and 120 may be minimized and thus the nano thin-film may be prevented from being damaged or deformed in transferring. In addition, the translational velocity may be accurately and precisely controlled even though the circumference of the first and second rollers 110 and 120 changes due to wear or deformation of the first and second rollers 110 and 120.

<Example Embodiment of Synchronizing Method 2>

Figure 7:
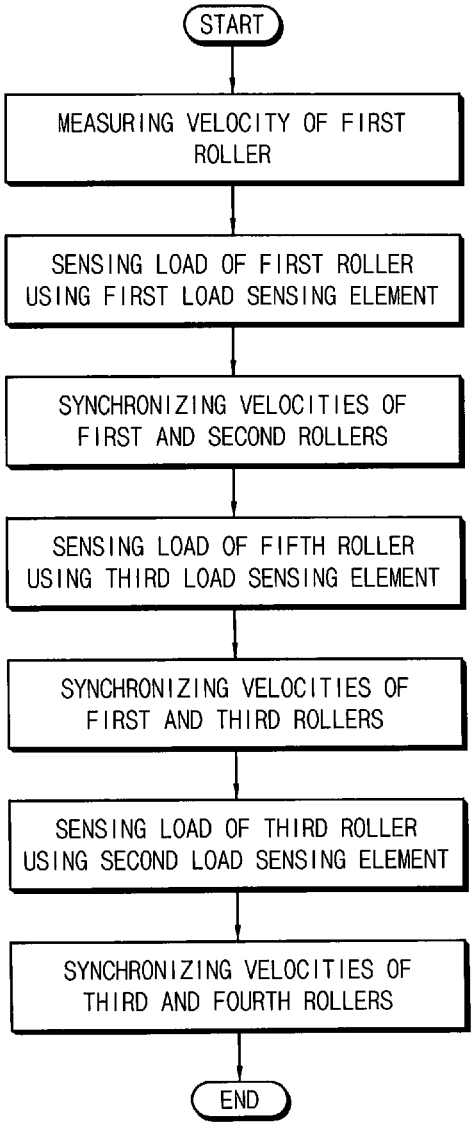
FIG. 7 is a flow chart illustrating a synchronizing method according to an example embodiment using the synchronizing apparatus of FIG. 4.
Figure 8:
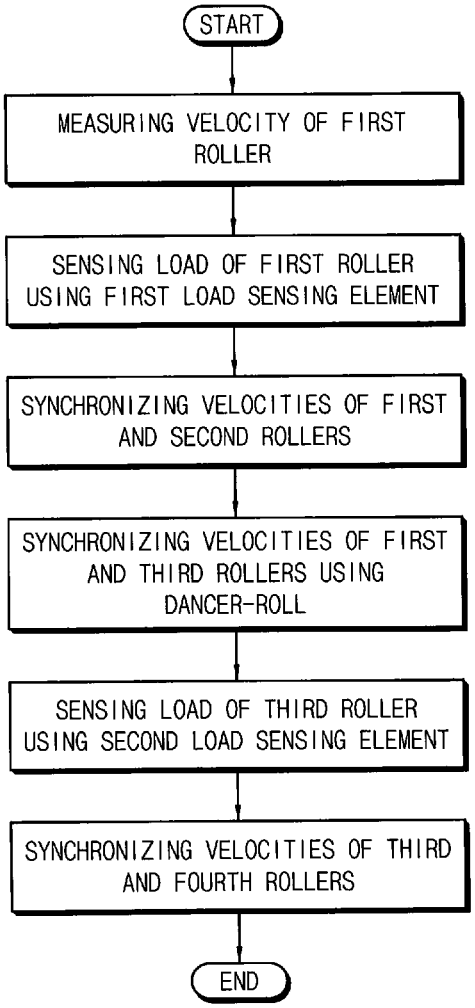
FIG. 8 is a flow chart illustrating a synchronizing method according to another example embodiment using the synchronizing apparatus of FIG. 4.

FIG. 7 is a flow chart illustrating a synchronizing method according to an example embodiment using the synchronizing apparatus of FIG. 4. FIG. 8 is a flow chart illustrating a synchronizing method according to another example embodiment using the synchronizing apparatus of FIG. 4. Referring to FIGS. 7 and 8, in the method according to the present example embodiment, the velocity of the first roller 210 is preset, and the velocity of the second roller 220 is synchronized based on the load of the first roller 210 via the first load sensing element 251 and 252. In addition, the velocities of the first and third rollers 210 and 230 are synchronized based on the tension of the nano thin-film on the fifth roller 250 via the tension sensing element 255, and the velocity of the fourth roller 240 is synchronized based on the load of the third roller 230 via the second load sensing elements 253 and 254.

Here, the tension sensing element 255 is the third vertical load sensor sensing the load of the fifth roller 250, and alternatively, as illustrated in FIG. 8, the tension sensing element 255 may be the dancer-roll.

First, the velocity of the first roller 210 is measured, and then the load of the first roller 210 is sensed via the first load sensing element 251 and 252. The first load sensing element 251 and 252 includes the first vertical load sensor 251 and the first horizontal load sensor 152, and senses the vertical load and the horizontal load applied to the first roller 210. Then, the control part 290 measures the frictional force between the nano thin-film and the first and second rollers 210 and 220 based on the vertical load and the horizontal load. The frictional force may be measured based on the conventional calculation equation to get the frictional force.

Then, the control part 290 synchronizes the translational velocity of the first rotational element 215 or the second rotational element 225 to minimize the frictional force, and the synchronizing may be performed in real time.

Then, the load of the main roller 261 is sensed via the tension sensing element 255. The tension sensing element 255 is the third vertical load sensor, and senses the vertical load applied to the main roller 261. Then, the tension between the first and second rollers 210 and 220 and the third and fourth rollers 230 and 240 is measured based on the vertical load. The frictional force may be measured based on the conventional calculation equation to get the frictional force.

Alternatively, the tension sensing element 255 may be the dancer-roll configured in the main roller 261 as illustrated in FIG. 8.

Then, the control part 290 synchronizes the translational velocity of at least one of the first to fourth rotational elements 215, 225, 235 and 245 to maintain the tension uniformly, for example to maintain the tension as a predetermined value. The above synchronizing may be performed in real time.

Then, the load of the third roller 230 is sensed via the second load sensing element 253 and 254. The second load sensing element 253 and 254 includes the second vertical load sensor 253 and the second horizontal load sensor 254, and senses the vertical load and the horizontal load applied to the third roller 230. Then, the control part 290 measures the frictional force between the nano thin-film and the third and fourth rollers 230 and 240 based on the vertical load and the horizontal load. The frictional force may be measured based on the conventional calculation equation to get the frictional force.

Then, the control part 290 synchronizes the translational velocity of the third rotational element 235 or the fourth rotational element 245 to minimize the frictional force, and the synchronizing may be performed in real time.

Accordingly, the frictional force between the nano thin-film and the first to fourth rollers 210, 220, 230 and 240 may be minimized and thus the nano thin-film may be prevented from being damaged or deformed in transferring. In addition, the translational velocity may be accurately and precisely controlled even though the circumference of the first to fourth rollers 210, 220, 230 and 240 changes due to wear or deformation of the first to fourth rollers 210, 220, 230 and 240. In addition, the tension of the nano thin-film in the roll-to-roll transfer device may be sensed and controlled in synchronization, and thus the nano thin-film may be prevented from being damaged of deformed in transferring.

The foregoing is illustrative of the present teachings and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. An apparatus for synchronizing a roll-to-roll transfer device, the apparatus comprising:

a thin-film transferred by the roll-to-roll transfer device;

a first roller making contact with a lower surface of the thin-film, and rotating with a rotational axis via a first rotational element;

a second roller disposed over the first roller, making contact with an upper surface of the thin-film, and rotating with the rotational axis via a second rotational element;

a first load sensing element sensing a load of the first roller or a load of the second roller;

a control part synchronizing a translational velocity of the first rotational element or the second rotational element based on the load sensed by the first load sensing element;

a third roller spaced apart from the first roller along a transfer direction of the thin-film, making contact with the lower surface of the thin-film, and rotating with the rotational axis via a third rotational element;

a fourth roller disposed over the third roller, making contact with the upper surface of the thin-film, and rotating with the rotational axis via a fourth rotational element;

a fifth roller disposed between the first and third rollers, making contact with the upper surface or the lower surface of the thin-film, and rotating with the rotational axis via a fifth rotational element;

a second load sensing element sensing a load of the third roller or the fourth roller;

and a tension sensing element sensing a tension of the thin-film on the fifth roller, wherein the control part synchronizes a translational velocity of the third rotational element or the fourth rotational element based on the load sensed by the second load sensing element, and synchronizes rotational angular velocities of at least one of the first and fourth rotational elements by the tension sensing element.

2. The apparatus of claim 1, wherein the first load sensing element comprises:

a first vertical load sensor sensing a load perpendicular to the rotational axis and perpendicular to the transfer direction of the thin-film; and a first horizontal load sensor sensing a load perpendicular to the rotational axis and parallel with the transfer direction.

3. The apparatus of claim 1, wherein the control part measures a frictional force between the thin-film and the first and second rollers using the first load sensing element, and synchronizes the translational velocity of the first rotational element or the second rotational element to minimize the frictional forces.

4. The apparatus of claim 1, wherein the second load sensing element comprises:

a second vertical load sensor sensing a load perpendicular to the rotational axis and perpendicular to the transfer direction of the thin-film; and a second horizontal load sensor sensing a load perpendicular to the rotational axis and parallel with the transfer direction.

5. The apparatus of claim 4, wherein the tension sensing element comprises a third vertical load sensor sensing a load perpendicular to the rotational axis of the fifth roller and perpendicular to the transfer direction.

6. The apparatus of claim 4, wherein the tension sensing element is a dancer-roll disposed on the fifth roller.

7. The apparatus of claim 1, wherein the control part:

measures a frictional force between the thin-film and the third and fourth rollers using the second load sensing element, and synchronizes the translational velocity of the third rotational element or the fourth rotational element to minimize the frictional forces, and measures a tension of the thin-film between two pairs of rollers, one pair being the first and second rollers, the other pair being the third and fourth rollers, using the tension sensing element, and synchronizes the translational velocity of the first and second rotational elements or the third and fourth rotational elements to uniformly maintain the tension.

8. The apparatus of claim 1, wherein the fifth roller comprises:

a main roller making contact with the lower surface of the thin-film, a lower end of the main roller being disposed over upper ends of the first and third rollers; and a pair of sub rollers disposed at both sides of the main roller along the transfer direction of the thin-film, lower ends of the sub rollers being disposed parallel with the upper ends of the first and third rollers, wherein the tension sensing element senses a tension of the thin-film on the main roller.

9. The apparatus of claim 2, wherein the first vertical load sensor and the first horizontal load sensor are load cells.

10. A method for synchronizing a roll-to-roll transfer device, the method comprising:

sensing a load of a first roller or a second roller using a first load sensing element;

calculating a frictional force between a thin-film and the first and second rollers using the load sensed by the first load sensing element;

synchronizing a translational velocity of a first rotational element or a second rotational element to minimize the frictional force via a control part;

sensing a load of a third roller or a fourth roller using a second load sensing element;

estimating a frictional force between the thin-film and the third and fourth rollers using the load sensed by the second load sensing element; and synchronizing a translational velocity of a third rotational element or a fourth rotational element to minimize the frictional force via the control part.

11. The method of claim 10, further comprising:

sensing a load of a fifth roller using a tension sensing element;

estimating a tension between the thin-film between two pairs of rollers, one pair being the first and second rollers, the other pair being the third and fourth rollers, using the load sensed by the tension sensing element; and synchronizing the translational velocity of the first and second rotational elements or the third and fourth rotational elements to uniformly maintain the tension.

12. The method of claim 10, further comprising:

sensing a tension of the thin-film on a fifth roller using a dancer-roll; and synchronizing the translational velocity of the first and second rotational elements or the third and fourth rotational elements to uniformly maintain the tension.

13. The apparatus of claim 1, wherein the first load sensing element comprises:

a first vertical load sensor sensing a load perpendicular to the rotational axis and perpendicular to the transfer direction of the thin-film; and a first horizontal load sensor sensing a load perpendicular to the rotational axis and parallel with the transfer direction;

the second load sensing element comprises:

a second vertical load sensor sensing a load perpendicular to the rotational axis and perpendicular to the transfer direction of the thin-film; and a second horizontal load sensor sensing a load perpendicular to the rotational axis and parallel with the transfer direction;

the tension sensing element comprises a third vertical load sensor sensing a load perpendicular to the rotational axis of the fifth roller and perpendicular to the transfer direction; and the first to third vertical load sensors and the first and second horizontal load sensors are load cells.

* * * * *